United States Patent [19]

Bilek et al.

[11] Patent Number: 4,694,786

[45] Date of Patent: Sep. 22, 1987

[54] ONE-CYLINDER, TWO-STROKE INTERNAL COMBUSTION ENGINE WITH CRANKCASE SCAVENGING

[75] Inventors: Andreas Bilek; Peter Wünsche, both of Graz, Austria

[73] Assignee: AVL Gesellschaft für Verbrennungskraftmaschinen und Messtechnik m.b.H., Prof.Dr.Dr.h.c. Hans List, Graz, Austria

[21] Appl. No.: 879,309

[22] Filed: Jun. 27, 1986

[30] Foreign Application Priority Data

Jul. 25, 1985 [AT] Austria ..... 2215/85

[51] Int. Cl.[4] ..... F02B 33/04

[52] U.S. Cl. ..... 123/73 AD; 123/196 R; 184/6.5

[58] Field of Search ..... 123/196 R, 73 AD, 73 A; 184/6.5, 6.8, 6.9

[56] References Cited

U.S. PATENT DOCUMENTS

| | | | |
|---|---|---|---|
| 2,273,202 | 2/1942 | Jackson | 123/73 AD |
| 2,682,259 | 6/1954 | Watkins | 123/73 A |
| 4,599,979 | 7/1986 | Breckenfeld et al. | 123/73 AD |

FOREIGN PATENT DOCUMENTS

| | | | |
|---|---|---|---|
| 949855 | 9/1956 | Fed. Rep. of Germany . | |
| 1190252 | 4/1965 | Fed. Rep. of Germany | 123/73 AD |
| 1244472 | 7/1967 | Fed. Rep. of Germany . | |
| 1476133 | 3/1969 | Fed. Rep. of Germany | 123/73 AD |

*Primary Examiner*—Craig R. Feinberg
*Assistant Examiner*—David A. Okonsky
*Attorney, Agent, or Firm*—Watson, Cole, Grindle & Watson

[57] ABSTRACT

A two-stroke internal combustion engine of the crankcase scavenging type, in which a nozzle connected to a lubricant feed line is provided in the intake passage for picking up oil from a lubricant reservoir via a partial vacuum. For simple and sufficient lubrication and cooling of the crank gear in accordance with the respective requirements of the engine, the nozzle (62) is positioned in the area of the smallest cross-section of a Venturi-tube-like part (60) of the intake passage, and an injection pump (54) is provided for fuel delivery, which eliminates the need for an oil pump.

10 Claims, 5 Drawing Figures

Fig. 1
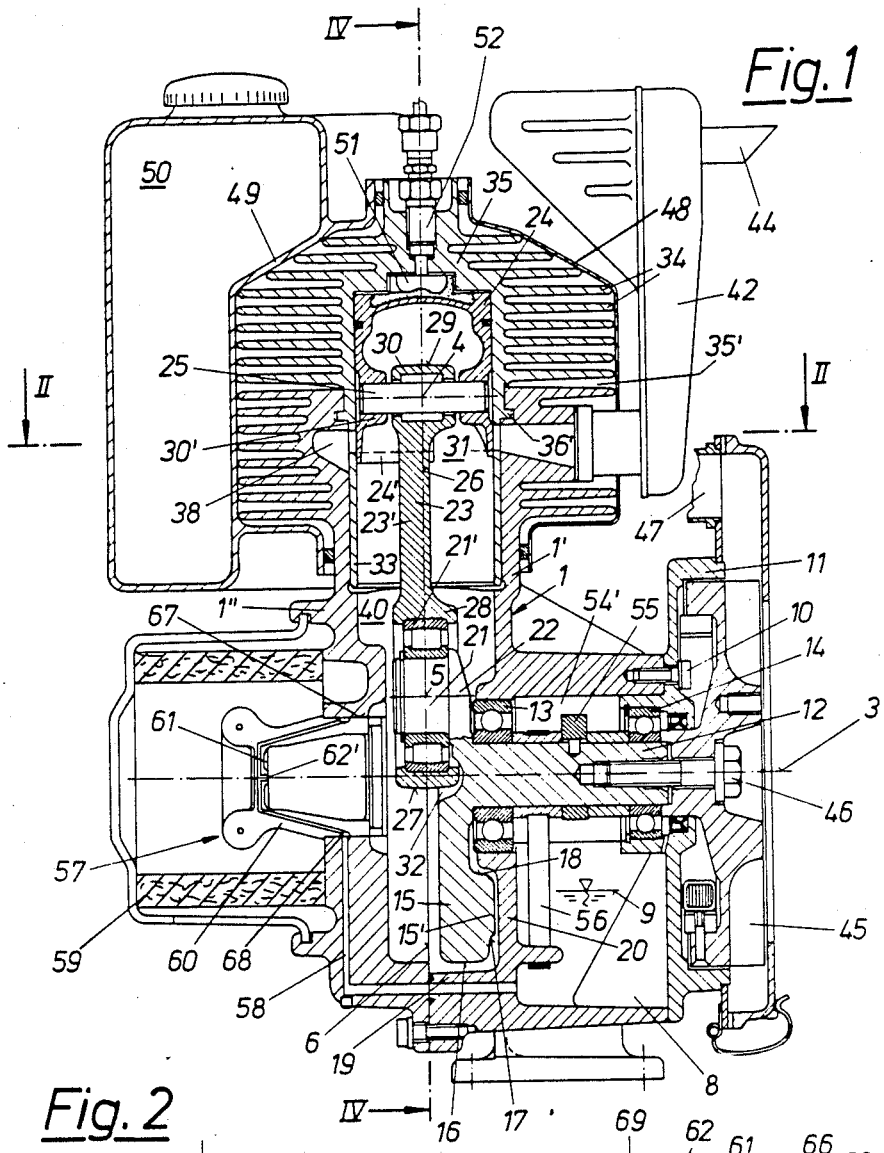
Fig. 2
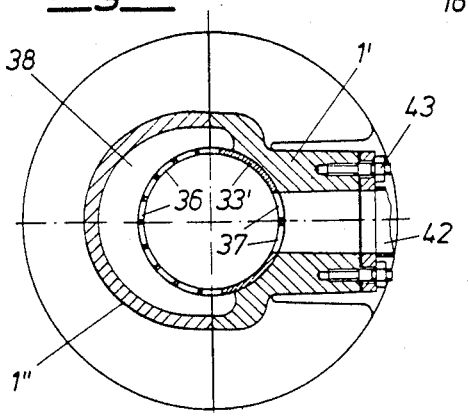
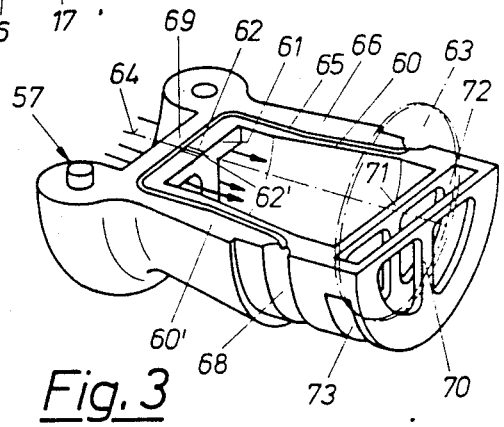
Fig. 3

ONE-CYLINDER, TWO-STROKE INTERNAL COMBUSTION ENGINE WITH CRANKCASE SCAVENGING

BACKGROUND OF THE INVENTION

This invention relates to a two-stroke internal combustion engine of the crankcase scavenging type whose air intake passage is furnished with a nozzle connected to a lubricant feed line, which nozzle draws in lubricating oil from a lubricant reservoir by means of partial vacuum.

DESCRIPTION OF THE PRIOR ART

A combustion engine of the noted type is shown in DE-AS 1,244,472. It has a carburetor which is provided with a pre-vaporizer mounted co-axially in the intake passage, into which vaporizer open both a feed pipe for the fuel/air mixture and a feed pipe for the lubricating oil. This known engine, however, has the disadvantage that the lubricating oil must be of extremely low viscosity. Besides, if the engine is operated at low temperatures, vaporization of the lubricating oil is not always satisfactory, which may cause severe damage to the engine due to lubrication failure.

Another two-stroke internal combustion engine with crankcase scavenging is described in DE-PS 949 855, with an oiler feeder pump delivering the lubricating oil from a supply tank to a nozzle positioned in the intake passage at a distance from a Venturi tube. With this known type of engine the lubricating oil is not drawn in by suction, but is delivered to the lubricating nozzle under pressure. The drawback of this solution is the complex mechanism needed for controlling and pressurizing the lubricant, i.e., control of the lubricant has to be effected together with the control of the fuel flow.

SUMMARY OF THE INVENTION

Based on an engine of the afore-mentioned type it is the main object of the present invention to offer a safe and mechanically simple method of lubricating and cooling the moving parts of the crank mechanism, in which the amount of lubricant delivered to the crankcase is geared to the specific requirements of the engine in order to avoid excess use of the lubricant.

According to the invention this is achieved by placing the nozzle in the narrowest part of the intake passage configured as a Venturi tube, and by providing a conventional injection pump for the delivery of fuel. As the nozzle for the lubricant is positioned in the narrowest part of the Venturi tube-type passage, the suction effect is strong enough to ensure satisfactory results without the use of an oil pump, which will simplify the design from a mechanical point of view. Besides, this design will ensure careful metering of the lubricant supply in accordance with the respective requirements of the engine — essentially speed-dependent —, since the vacuum in the Venturi tube-type passage which directly controls the amount of lubricant delivered through the nozzle opening, will depend among others on the flow rate of the intake air and thus on the numbers of revolutions of the engine.

In a further development of the invention the nozzle opening may be placed, at least approximately, in the center of the smallest cross-section of the intake passage, pointing in the direction of flow, which will further improve the discharge and dispersing of the lubricant in the inflowing intake air.

In a preferred from of the invention of an internal combustion engine designed as a diesel engine, the lubricant feed line, or rather the reservoir, may communicate with the engine fuel tank by a connecting line. In this way no separate storage tank is needed for the lubricating medium, since the lubricating effect of the diesel fuel will be sufficient. By the addition of vaporized diesel fuel to the intake air the lubricant mist in the crankcase is continuously renewed, which will help maintain the lubricating efficiency.

In this context it will be of advantage if the amount of fuel added as a lubricant to the intake air is kept smaller than that required for the idle state of the engine, by suitably matching the difference in diameter in the Venturi tube-type passage and the diameter of the nozzle opening, since this will eliminate the need for additional provisions for turning off the engine. If no maximum were established for the amount of fuel to be added to the intake air as a lubricant, the engine might continue to run on the amount of fuel added to the intake air even after the ordinary fuel supply has been shut off; this could be prevented, however, by providing suitable shut-off valves in the lubricant feed line.

In a preferred development the nozzle unit, or rather the section of the intake passage configured as a Venturi tube, may be designed as a separate part of light alloy or plastic produced by tranfer of injection molding, which may be furnished with a check valve or flap. This very simple configuration will permit a favorable shaping of the passage, the addition of a check valve in this separate area, which prevents the intake air from escaping from the crankcase on the downward stroke of the piston, i.e., as it compresses the contents of the crankcase, saving further space.

A particularly favorable variant of the invention provides that the passage configured as a Venturi tube consists of two essentially identical halves which are joined in a center plane containing the axis of the passage, and that the lubricant feed lines contained in this area be situated in this plane, as this arrangement permits simple and economic manufacturing.

In another variant of the invention, in which the crankshaft is supported on one side only (side-crank), the separate section of the intake passage is closely fitted into an opening in the part of the crankcase opposite the crankshaft bearings, concentrically to the crankshaft axis, and is directly surrounded by the air filter, which will permit utilization of the space available because of the side-crank system used, and will result in a particularly compact design.

The lubricant feed line in the crankcase may have a bore ending in the opening for the separate section of the intake passage, which bore communicates with the feed lines towards the nozzle opening in the inserted intake passage via an annular groove, which will simplify assembly and eliminate problems caused by a turning of the Venturi-type passage in the opening on the crankcase.

In yet another preferred variant of the invention the lubricant reservoir may be located in a separate chamber of the crankcase which also contains the one-sided crankshaft bearings and, possibly, the cam-controls of an injection pump, as well as a splash lubricator which is actuated by the rotating crankshaft, e.g., a loop belt. By means of this splash lubricator lubrication of the main crankshaft bearings — which are situated outside the crankcase in this arrangement — is guaranteed in a simple manner, without the use of additional bores, feed lines, etc.

DESCRIPTION OF THE DRAWINGS

Following is a more detailed description of the invention, by way of the example illustrated in the accompanying drawings, in which FIG. 1 is a section through the axes of the cylinder and the crankshaft of an engine as described by the invention, FIG. 2 is a section along line II—II in FIG. 1, FIG. 3 a view of a detail from FIG. 1, FIG. 4 a section along line IV—IV in FIG. 1, and FIG. 5 a section along line V—V in FIG. 4.

DETAILED DESCRIPTION OF THE PREFERRED EMBODIMENT

Figure 4:
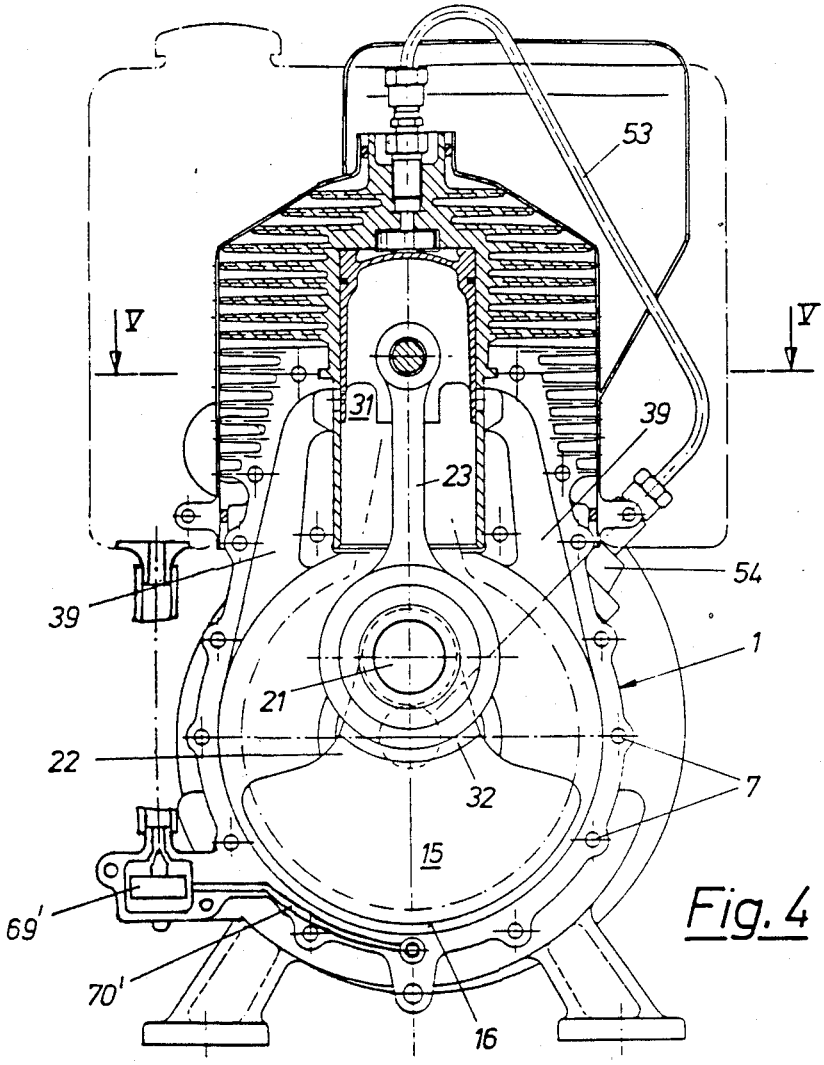
Figure 5:
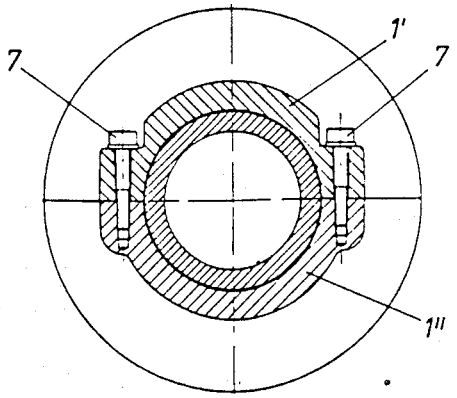

The port-controlled, two-stroke internal combustion engine with fuel injection, preferably a diesel engine, has a crankcase 1 consisting of parts 1' and 1'', the plane of partition 6 running normal to the crankshaft axis 3 and through the longitudinal center planes of the connecting rod bearings at the piston pin 4 and the crank pin 5. Parts 1' and 1'' of the crankcase are screwed together by a large number of screws 7 fastened in part 1'' and passing through 1'. Part 1' forms a chamber serving as a lubricant reservoir 8 whose oil level 9 is maintained constant by conventional devices, such as a float 69', etc. On the power output side the chamber 8 is closed by the bearing plate 11 which is fastened with screws 10 to part 1' of the crankcase.

The crankshaft 12 is supported on one side in part 1' of crankcase and in the bearing plate 11 by ball bearings 13 and 14 (main bearings). The free end of the crankshaft 12 carries the counter weight 15 whose thickened rim or bulge 15' partly extends behind the ball bearing 13. The contours 16 of the counterweight 15 as well as the contours 17 and 18 of the bulge 15' are concentric with the crankshaft 12. A counterweight passes part 1' of the crankcase, the distance between these contours and the corresponding walls 19 and 20 of part 1' are kept as small as is technically possible. In the direction of the crankshaft axis 3 the counterweight 15 is continued by the crankpin 21, one side of which is connected to the crankshaft 12 by means of the crank 22. Via the corresponding bearing 21', the crankpin 21 is connected to the piston 24 by means of the one-piece connecting rod 23 via the piston pin 25 held in eyes 30' on the piston 24. The shaft 23' of the connecting rod 23 is eccentric relative to the piston or cylinder axis 26, i.e., displaced away from the crankshaft bearing 13. The outer contours 27 of the eye 28 of the crankpin bearing and the outer contour 29 of the eye 30 of the the piston pin bearing of the connecting rod 23 are concentric with bearing axes.

On the side of the counterweight 15 the body 24' of the piston 24 has recesses 31 into which the counterweight 15 enters with an minimum of play in its position near the bottom dead center. The counterweight 15, or rather the crank 22, has a groove 32 concentric with the axis of the crankpin 21, providing space for the eye 28 of the crankpin bearing. With these measures it is possible to keep wasted space at a minimum.

The piston 24 slides in the cylinder liner 33 which is combined in one piece with cylinder head 35 carrying cooling ribs 34. This cylinder head/cylinder linear unit is held tightly between parts 1' and 1'' of the crankcase, for which purpose the cylinder linear 33 has a flange 36' along its circumference. The gap separating the cylinder head 35 and the crankcase 1 is marked 35'.

The cylinder liner 33 has intake ports 36 for the air compressed in the crankcase interior 40, and exhaust ports 37 for the combustion gases, both of which are controlled by the piston 24. In the area 33' of the cylinder liner 33 there are no scavenge ports because of the recesses 31 in the piston body 24'. The intake ports 36 are fed from a chamber 38 which in turn communicates with the crankcase interior 40 by way of the scavenge passages 39 provided at least in part 1' of the crankcase in the area of the partition plane 6. In addition to other advantages, this particular configuration of the scavenge passages 39 permits the use of coreless molding techniques for manufacture. Via an exhaust passage 41 the exhaust ports 37 communicate with the sound-absorbing exhaust unit 42, which in its turn is fastened to part 1' of the crankcase by screws 43 and is provided with the exhaust stub 44.

On the power output side a radiator fan 45 is provided which is fastened to the crankshaft 12 by means of the main screw 46. The cooling air is transported to the cooling ribs 34 through a connecting pipe 47, for which purpose the ribs 34 are provided with a jacket which is constituted by a cover 48 and the inner wall 49 of the fuel tank 50.

Fuel is fed into the combustion chamber 51 located in the piston 24 from the nozzle 52 via the injection line 53 connected to the injection pump 54 (not shown in detail in the drawing). In the separate chamber 54' of the crankcase 1 formed by the main crankshaft bearings 13 and 14, the cam 55 for the injection pump is mounted on the camshaft 12 to which it is rigidly attached. Lubrication of the injection cam 55 and the main bearings 13, 14 is effected by an oil mist which is generated by an endless loop 56 of flexible material extending below the fuel level 9, being borne and driven by the crankshaft 12.

Lubrication of the drive mechanism is effected via a nozzle unit 57 which is fed with fuel acting as a lubricant through the angled lubricant feed line 58. The nozzle unit 57 also is in connection with the intake air coming in through the air filter 59. Part 1'' of the crankcase has a cylindrical opening 67 coaxial with the crankshaft axis 3 into which is inserted part 60 of the intake passage which is configured as a Venturi tube. Part 60 consists of two identical halves 60' whose seam is in a center plane 66 containing the axis 64 of the intake passage. Preferably, these halves 60' are plastic moldings which are bonded.

The center plane of partition 66 contains lubricant feed lines 65, identically configured as open grooves in both halves, which form closed pipes after the two halves 60' have been bonded. The feed lines 65 are fed from an annular groove 68 which is covered by the wall of the cylindrical opening 67 and which communicates with the lubricant reservoir 8 via the lubricant feed line 58 and a connecting line 70', the latter containing a float 69'. In the area of the smallest cross-section 61 of part 60 of the intake passage a nozzle 62 pointing in the same direction as axis 64 is mounted in a cross-rib 69, the nozzle opening being marked 62'. At the end of part 60 opposite the nozzle 62 are located the two front walls 70, 71 provided with openings, between which walls is positioned a check-value 63, e.g., configured as a movable disk of sheet metal. From the moving space 72 of the check-valve 63, which is bounded by the two front walls 70, 71, a circumferential slit 73 opens into the crankcase interior 40. In this way the check-valve 63 is pressed against the front wall 70 on the intake stroke, and the intake air may flow freely into the crankcase through the slit 73. On the compression stroke, however, the check-valve 63 is pressed against the front wall 71, which will prevent the intake air from flowing back.

During each intake stroke a partial vacuum is created at the nozzle opening 62' situated in the area of the smallest cross-section 61 of part 60 of the intake passage, which is configured as a Venturi tube, by which vacuum a metered quantity of lubricant is sucked in through the nozzle 62. The vaporized lubricant mixes with the intake air to form a dispersion, and enters the crankcase interior 40 where it lubricates all the moving parts. The level 9 in the lubricant reservoir 8 is maintained constant by conventional means supplying fuel from the fuel tank 50 as required. The amount of fuel thus added to the intake air as a lubricant is kept smaller than that required for the idle state of the engine by adjusting the difference in diameter in the Venturi tube and the diameter of the nozzle opening 62'.

We claim:

1. A crankcase-scavenging internal combustion engine which comprises a crankcase which defines an opening for a mixture of air and lubricant, a crankshaft rotatably mounted in said crankcase, a lubricant reservoir containing lubricant, a part positioned over said opening of said crankcase for providing a mixture of air and lubricant thereto when a vacuum is created in said crankcase, said part including a bottom end having a cross-rib, a side wall and a top end and defining a chamber therein which has a first diameter adjacent said bottom end and an increasing diameter between said bottom end and said top end, said part also defining a nozzle located in said cross-rib and communicating with said chamber, at least one lubricant feed line extending in said side wall and in said cross-rib to communicate with said nozzle, and air intake openings at said bottom end, and a lubricant supply line extending from said lubricant reservoir to said part to supply lubricant to each lubricant feed line in said part.

2. A two stroke diesel engine with crankcase scavenging comprising a crankcase, a fuel tank for containing fuel; an injection pump providing fuel to said diesel engine; a part forming an air intake passage, said part being configured as a Venturi tube and having an area of smallest cross section and a direction of fluid flow a nozzle located in said Venturi tube at the center of said area of smallest cross section and directed in said direction of fluid flow; a lubricant reservoir; and a lubricant feed line extending from said lubricant reservoir to said nozzle.

3. The diesel engine according to claim 2, wherein said nozzle has a diameter which is sufficiently smaller than the internal diameter of said part, such that amount of fuel added to intake air as a lubricant is less than that required for the idle state of the engine.

4. The diesel engine according to claim 2, wherein said part configured as a Venturi tube comprises a separate part of light alloy or plastic having a check-valve.

5. The diesel engine according to claim 4, wherein said part which is configured as a Venturi tube comprises two essentially identical halves joined at a center plane containing the axis of said air intake passage, and wherein feeder lines of said lubricant feed line are located in said center plane.

6. The diesel engine according to claim 5, further including a crankshaft supported by crankshaft bearings on one side only, said crankcase having an opening opposite said bearings wherein said part which is configured as a Venturi tube is fitted into and is concentric with the axis of said crankshaft, and an air filter being located in said opening.

7. The diesel engine according to claim 6, wherein said lubricant feed line in said crankcase has a bore ending in said opening, said bore communicating with said feeder lines toward said nozzle opening via an annular groove in said part forming said intake passage.

8. The diesel engine according to claim 7, wherein said crankcase has a separate chamber forming said lubricant reservoir, cams for said injection and a splash lubricator actuated by said rotating crankshaft, said chamber also containing said bearings, said cams and said splash lubricator.

9. The diesel engine according to claim 6, wherein said crankcase has a separate chamber forming said lubricant reservoir, cams for said injection and a splash lubricator actuated by said rotating crankshaft, said chamber also containing said bearings, said cams and said splash lubricator.

10. The diesel engine according to claim 9, wherein said splash lubricator comprises a loop belt.

* * * * *